US008294381B2

(12) United States Patent
Ge et al.

(10) Patent No.: US 8,294,381 B2
(45) Date of Patent: Oct. 23, 2012

(54) PWM DIMMING CIRCUIT FOR LED

(75) Inventors: Liangan Ge, Zhejiang (CN); Xiaoli Yao, Zhejiang (CN); Guichao Hua, Zhejiang (CN); Lijun Ren, Zhejiang (CN)

(73) Assignee: Inventronics (Hangzhou) Co., Ltd., Hangzhou, Zhejiang (CN)

( * ) Notice: Subject to any disclaimer, the term of this patent is extended or adjusted under 35 U.S.C. 154(b) by 229 days.

(21) Appl. No.: 12/860,776

(22) Filed: Aug. 20, 2010

(65) Prior Publication Data

US 2011/0043115 A1 Feb. 24, 2011

(30) Foreign Application Priority Data

Aug. 20, 2009 (CN) ..... 2009 1 0101642

(51) Int. Cl.
*H05B 37/02* (2006.01)
*H05B 41/36* (2006.01)

(52) U.S. Cl. ..... 315/246; 315/307

(58) Field of Classification Search ..... 315/246, 315/119, 291, 307, 224, 244, 312
See application file for complete search history.

(56) References Cited

U.S. PATENT DOCUMENTS

2004/0251854 A1* 12/2004 Matsuda et al. ..... 315/291
2008/0136350 A1* 6/2008 Tripathi et al. ..... 315/294

* cited by examiner

*Primary Examiner* — Daniel D Chang
(74) *Attorney, Agent, or Firm* — Terry M. Sanks; Beusse Wolter Sanks Mora & Maire, P.A.

(57) ABSTRACT

A PWM dimming circuit for a LED load including a LED load connected to the main LED drive circuit, a current loop configured to measure output current from the LED load, a current loop regulation circuit connected to the current loop, a main control circuit configured to receive a signal from the current loop when the LED load produces an output current, and a PWM dimming controller configured to provide a signal to control the current loop regulation circuit and to make the current loop operate in a closed-loop mode when the LED load produces the output current and to provide a shutdown signal to the main control circuit when the LED load does not produce the output current. When the output current is detected, the main control circuit controls the main LED drive circuit to set its output current at a predetermined load current.

19 Claims, 5 Drawing Sheets

PWM DIMMING CIRCUIT FOR LED

CROSS-REFERENCE TO RELATED APPLICATIONS

This application claims priority of Chinese Patent Application No. 200910101642.X filed Aug. 20, 2009, which is incorporated herein by reference.

BACKGROUND OF THE INVENTION

Exemplary embodiments of the invention generally relate to a light emitting diode ("LED") circuit and, more particularly, to a pulse width modulation ("PWM") dimming circuit for LED, and more particularly.

A high power LED lamp has such advantages as high luminous efficiency, long life, and environmental protection when compared to incandescent and/or fluorescent lighting. It is believed that using LED instead of incandescent, fluorescent, and other traditional lighting will be a new trend in the coming years. LED has simplicity of driving and controlling, and illumination intensity is easy to be adjusted flexibly. LED dimming modes usually comprise DC dimming, PWM dimming and other dimming. Compared with DC dimming, PWM dimming has advantages of a constant lighting color, and good stability at low brightness.

Typically, a constant-current LED driver with loop compensation methods as a current closed-loop has slow current loop dynamic response. It is difficult for the output current to fast-track to PWM dimming signal. Thus LED lamp current can not reach the desired chopping regulation with the variation PWM signal duty cycle.

BRIEF DESCRIPTION OF THE INVENTION

Exemplary embodiments of the present invention relate to a circuit for providing a PWM dimming circuit for LED.

In one exemplary embodiment, the circuit comprises a main LED drive circuit, a LED load connected to the main LED drive circuit, a current loop configured to measure output current from the LED load, a current loop regulation circuit connected to the current loop, a main control circuit configured to receive a signal from the current loop when the LED load produces an output current, and a PWM dimming controller configured to provide a signal to control the current loop regulation circuit and to make the current loop operate in a closed-loop mode when the LED load produces the output current and to provide a shutdown signal to the main control circuit when the LED load does not produce the output current. When the output current is detected, the main control circuit controls the main LED drive circuit to set its output current at a predetermined load current. When the output current is not detected, the main control circuit controls the LED driver main circuit to shut down.

In another exemplary embodiment, the circuit comprises a main LED drive circuit, a LED load connected to the main LED drive circuit, an output capacitor C connected in parallel to the main LED drive circuit and the LED load, a current loop configured to measure output current from the LED load, a current loop regulation circuit connected to the current loop, a main control circuit configured to receive a signal from the current loop when the LED load produces an output current, an output control switch connected between the LED load and the current loop, and a PWM dimming controller configured to controls the output control switch to let in a conduction state and to provide a signal to control the current loop regulation circuit and makes the current loop work in a closed-loop mode when the LED load produces the output current and to provide a shutdown signal to the main control circuit and the output control switch when the LED load does not produce the output current. When the output current is detected, the main control circuit controls the main LED drive circuit to set its output current at a predetermined load current. When the output current is not detected, the main control circuit controls the LED driver main circuit and the output control switch to shut down.

In yet another exemplary embodiment, the circuit comprises a main LED drive circuit, a LED load connected to the main LED drive circuit, an output capacitor connected in parallel to the main LED drive circuit and the LED load, a current loop configured to measure output current from the LED load, a current loop regulation circuit connected to the current loop, a main control circuit configured to receive a signal from the current loop when the LED load produces an output current, an output control switch connected between the LED load and the current loop, and a PWM dimming controller configured to control the output control switch to let in a conduction state and to provide a signal to control the current loop regulation circuit and make the current loop work in a closed-loop mode when the LED load produces the output current and to provide a shutdown signal to the output control switch when the LED load does not produce the output current. When the output current is detected, the main control circuit controls the main LED drive circuit to set its output current at a predetermined load current.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
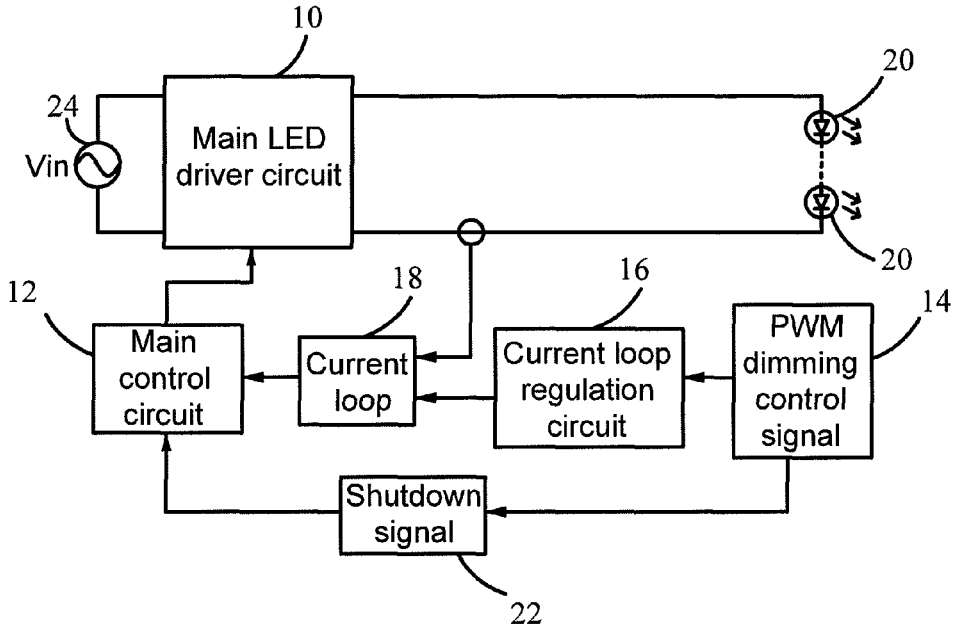
FIG. 1 is an exemplary embodiment of a circuit diagram of a PWM dimming circuit for a LED with an output of the LED driver main circuit not including an output capacitor.

Reference will be made below in detail to exemplary embodiments of the invention, examples of which are illustrated in the accompanying drawings. Wherever possible, the same reference numerals used throughout the drawings refer to the same or like parts. Exemplary embodiments of the invention solve problems in the art by providing a pulse width modulation (PWM) dimming circuit for a LED lighting application.

For the sake of easy explain, the description of exemplary embodiments of the invention are provided under the following assumptions. It is supposed when a duty cycle of a PWM dimming control signal is maximum, LED lights are the brightest, and when minimum, LED lights are the darkest. At a time of a high PWM signal, the LED load has an output current, called the 'Ton' time. At a time of a low PWM signal, LED load (or simply LED) has no output current, called the 'Toff' time.

Exemplary embodiments of the present invention adopts a PWM dimming circuit for the LED load which is applicable to three different occasions: (1) an output of a LED driver main circuit does not include an output capacitor; (2) the output of LED driver main circuit, with an output capacitor, needs to turn a main control circuit off in 'Toff' duration; (3) the output of LED driver main circuit, with the output capacitor, but does not need to turn the main control circuit off in 'Toff' duration.

FIG. 1 is an exemplary embodiment of a circuit diagram of a PWM dimming circuit for a LED with an output of the LED driver main circuit not including an output capacitor. The PWM dimming circuit for the LED comprises a LED drive main circuit 10, a main control circuit 12, a PWM dimming controller 14 that provides a signal (throughout this document PWM dimming control signal is used interchangeably with the controller that provides the signal), a current loop regulation circuit 16, a current loop 18, a LED load 20 (one or more LED strings), and a shutdown signal 22 produced by the PWM dimming controller 14. As further is illustrated an AC power source 24 is connected to the LED driver main circuit 10.

During the 'Ton' time, the PWM dimming control signal 14 controls the current loop regulation circuit 16 and makes the current loop 18 work in a "normal" closed-loop mode where a current sampling signal compares with an internal current reference signal of the current loop 18, and a output signal is adjusted through the closed-loop and feeds to the main control circuit 12. The main control circuit 12 acts on the main LED drive circuit 10 to set its output current as the predetermined load current. The PWM dimming control signal 14 does not send a shutdown signal to the main control circuit 12. During the 'Toff' time, the PWM dimming control signal 14 controls the current loop regulation circuit 16. The current sampling signal of the current loop is forced to be equal to the current reference signal by the current loop regulation circuit output, so that the output of the current loop 18 remains unchanged. At the same time, the PWM dimming control signal 14 sends the shutdown signal 22 to the main control circuit 12. The main control circuit 12 acts on the Main LED drive circuit 10 and shuts it down, and the output current turns zero.

The PWM dimming control signal 14, or controller, regulates the current loop 18 through the current regulation circuit 16 in the 'Toff' time, so that the output of current loop 18 remains unchanged. The PWM dimming control signal 14 controls shutdown signal simultaneously to turn the LED driver main circuit 10 off in the Toff time and to reduce the output current to zero rapidly. Due to the current loop output remaining unchanged during the 'Toff' period of time, the load current tracks the current reference signal only in the 'Ton' period of time. Thus the LED load current can track the variation of the PWM dimming control signal duty cycle fast, or at a very high rate of speed.

Figure 2:
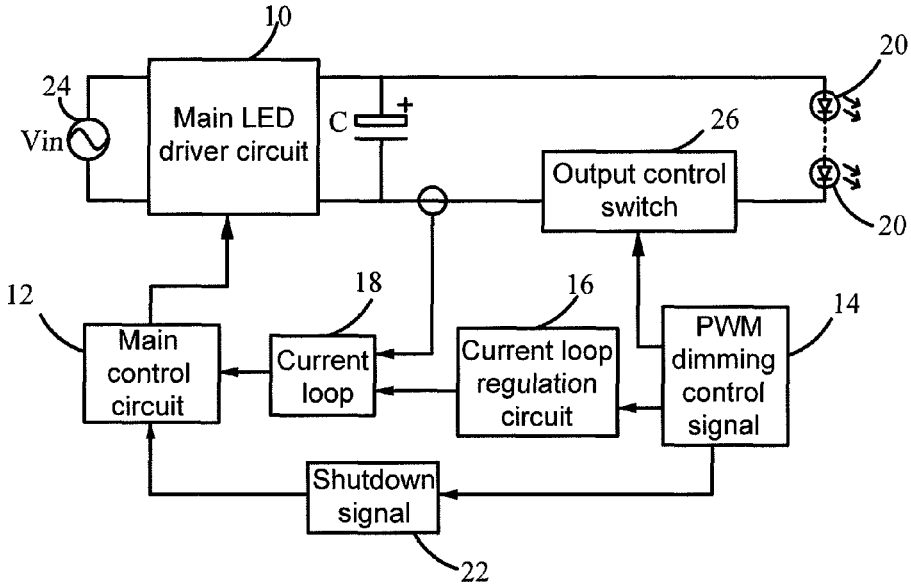
FIG. 2 is an exemplary embodiment of a circuit diagram of a PWM dimming circuit for a LED where the output of LED driver main circuit, with an output capacitor, needs to turn a main control circuit off in 'Toff' duration.

FIG. 2 is an exemplary embodiment of a circuit diagram of a PWM dimming circuit for a LED where the output of LED driver main circuit, with an output capacitor C, needs to turn a main control circuit off in 'Toff' duration. In this occasion, the PWM dimming circuit for the LED comprises an LED driver main circuit 10, an output capacitor C, a main control circuit 12, an output control switch 26, a PWM dimming control signal (or controller) 14, a current loop regulation circuit 16, a current loop 18, a LED load 20 (one or more LED strings), and a shutdown signal 22.

During the 'Ton' time, the PWM dimming control signal 14 controls the output control switch 26 to let it operate in a conduction state. The PWM dimming control signal 14 further controls the current loop regulation circuit 16 and makes the current loop 18 work in the normal closed-loop mode where the current sampling signal compares with the internal current reference signal of the current loop 18, and the output signal is adjusted through the closed-loop and feeds to the main control circuit 12. The main control circuit 12 acts on the LED drive main circuit 10 to set its output current as the predetermined load current. The PWM dimming control signal 14 does not send a shutdown signal 22 to the main control circuit 12. During the 'Toff' time, the PWM dimming control signal 14 controls the current loop regulation circuit 16. The current sampling signal of the current loop 18 is forced to be equal to the current reference signal by the output of the current loop regulation circuit 16, so that the output of current loop 18 remains unchanged. The PWM dimming control signal 14 sends the shutdown signal 22 to the main control circuit 12 to turn off the LED driver main circuit. At the same time, the PWM dimming control signal 14 controls the output control switch off and the LED load current turns zero.

The PWM dimming control signal 14 regulates the current loop through the current regulation circuit 16 in the 'Toff' time, so that the output of current loop 18 remains unchanged. Because of energy storage in the output capacitor C, the PWM dimming control signal 14 turns the output control switch 26 off to rapidly reduce the output current to zero in the 'Toff' time. Due to the current loop output remaining unchanged during the 'Toff' period of time, the load current tracks current reference signal only in the 'Ton' period of time. Thus the LED load current can track the variation of the PWM dimming control signal 14 duty cycle rather quickly, or rapidly.

The output capacitor C does not output energy to the load 20 any more in the 'Toff' time. When the 'Toff' is long (small duty cycle), the capacitor voltage may be increased, causing the load current amplitude increased (higher than the set value). In this case, the PWM dimming control signal 14 sends shutdown signal to the main control circuit 12 in the 'Toff' time. It stops the LED driver main circuit 10 from working, so that the voltage on the output capacitor C can be controlled without increasing and the load current amplitude will not change. As a result, the ideal variation of the output current of the LED driver main circuit 10 can be achieved and can also obtain a good LED lamp dimming effect.

Figure 3:
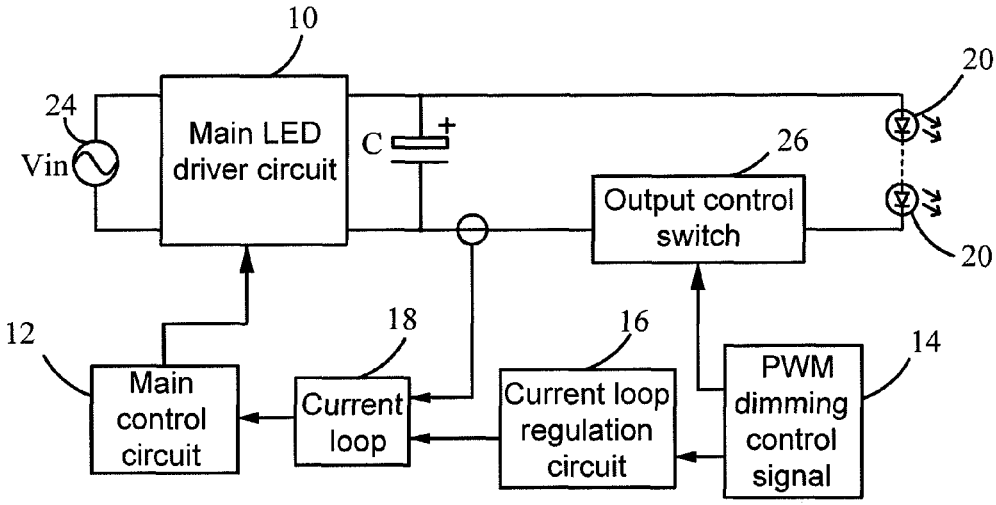
FIG. 3 is an exemplary embodiment of a circuit diagram of a PWM dimming circuit for a LED where the output of LED driver main circuit, with the output capacitor, but does not need to turn the main control circuit off in 'Toff' duration.

FIG. 3 is an exemplary embodiment of a circuit diagram of a PWM dimming circuit for a LED where the output of LED driver main circuit, with the output capacitor, but does not need to turn the main control circuit off in 'Toff' duration. The PWM dimming circuit for the LED comprises a LED driver main circuit 10, an output capacitor C, a main control circuit 12, an output control switch 26, a PWM dimming control signal (or controller) 14, a current loop regulation circuit 16, a current loop 18, and a LED load 20 (one or more LED strings).

During the 'Ton' time, the PWM dimming control signal 14 controls the output control switch 26 to let it operate in the conduction state; the PWM dimming control signal 14 controls the current loop regulation circuit 16 and makes the current loop 18 work in a closed-loop mode where a current sampling signal compares with an internal current reference signal of the current loop 18, and the output signal feeds to the main control circuit 12. The main control circuit 12 acts on the LED driver main circuit 10 to set its output current as the predetermined load current. During the 'Toff' time, the PWM dimming control signal 14 controls the current loop regulation circuit 16. The current sampling signal of the current loop 18 is forced to be equal to the current reference signal by the output of the current loop regulation circuit 16, so that the output of the current loop 18 remains unchanged. At the same time, the PWM dimming control signal 14 controls the output control switch 26 in the off state and the LED load current turns zero.

The PWM dimming control signal 14 regulates the current loop 18 through the current regulation circuit 16 in the 'Toff' time, so that the output of the current loop 18 remains unchanged. Because of energy storage of the output capacitor C, the PWM dimming control signal 16 turns the output control switch 26 off to reduce the output current to zero rapidly in the 'Toff' time. Due to the current loop output remaining unchanged during the 'Toff' period of time, the load current tracks current reference signal only in the 'Ton' period of time. Thus, the LED load current can track the variation of the PWM dimming control signal duty cycle fast.

The circuit structure is simpler in comparison with where the output of LED driver main circuit 10, with an output capacitor C, needs to turn a main control circuit 12 off in 'Toff' duration, as illustrated in FIG. 2. The capacity of the output capacitor C is required to be large enough in the main circuit design to ensure the output capacitor voltage will not rise in the longest 'Toff' case. As a result, constant amplitude of load current can be achieved to obtain a good dimming result.

In an exemplary embodiment, an output current waveform of LED driver main circuit 10 is a chopping square wave. The frequency and duty cycle of a square wave are the same as the PWM dimming control signal 14 and its amplitude remains unchanged. The average value of the output current is equal to the product of the output current amplitude and duty cycle. The output current duty cycle varies with the variation of the duty cycle of the PWM dimming control signal 14, and always is consistent with it. In this way, the average output current varies with the duty cycle of the PWM dimming control signal 14. Therefore, when the PWM signal duty cycle increases, the duty cycle of the output current is increased and the average output current is also increased, wherein the LED lamp is much brightened and/or vice versa.

Figure 4:
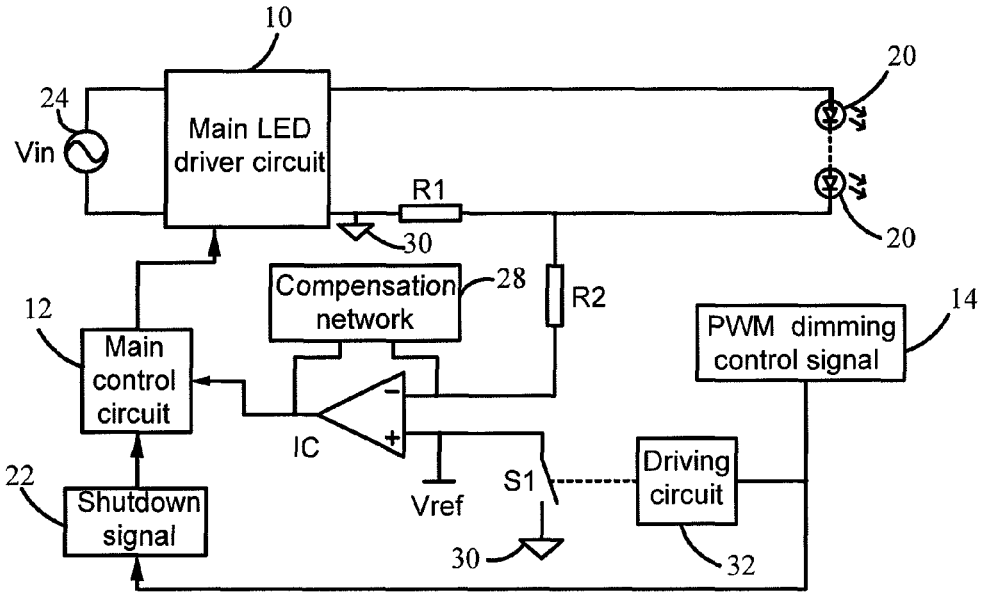
FIG. 4 is another exemplary embodiment of a circuit diagram of a PWM dimming circuit for a LED with an output of the LED driver main circuit not including an output capacitor.

FIG. 4 is another exemplary embodiment of a circuit diagram of a PWM dimming circuit for a LED with an output of the LED driver main circuit not including an output capacitor. The input of the LED driver main circuit 10 is an AC voltage Vin or 24, and the positive output terminal connects the anode of the LED load 20, while the cathode of the LED load 20 is connected with one end of a first resistor R1 and one end of a second resistor R2. The current loop 18 comprises an integrated operational amplifier (op-amp) component or IC, a compensation network 28, as well as the first resistor R1 and the second resistor R2. A negative input terminal of the IC connects with the other end of the second resistor R2, and the other end of the first resistor R1 is connected to the ground 30. A positive input terminal of the IC is connected to a current-reference voltage Vref, and the compensation network 28 is in parallel with the negative input terminal and output terminal of the integrated op-amp IC. The output end of the IC connects with the main control circuit 12. The current loop regulation circuit 16 consists of a first switch S1 and its driving circuit 32. The second terminal of the first switch S1 is connected with the positive input terminal of the integrated op-amp IC and the current-reference voltage Vref, while the first terminal of the first switch S1 is connected to ground 30, and the third terminal of the first switch S1 is connected with its driving circuit 32 which is controlled by the PWM dimming control signal 14. The PWM dimming control signal 14 controls the shutdown signal 22, and the main control circuit 12 receives the shutdown signal 22 and the signal of the current loop 18, and then output the signal to the LED driver main circuit 10.

During the 'Ton' time, the PWM dimming control signal 14 does not output a shutdown signal 22 to the main control circuit 12. The PWM dimming control signal 14 controls the output of the driving circuit 32 to be low, and the switch S1 is turned off. The current loop 18 works in the normal closed-loop mode, namely that the current sampling signal is input to the negative input terminal of the integrated op-amp IC by resistor R1, then it compares with the current-reference signal Vref of the positive terminal of the integrated op-amp IC, and outputs the signal to the main control circuit 12. The main control circuit 12 acts on the LED driver main circuit 10 to set its output current as the predetermination load current. During the 'Toff' time, the PWM dimming control signal 14 controls the output of the driving circuit 32 to be high, and the switch S1 is on. The current sample signal of the current loop 18 and the current-reference signal Vref are zero, and the current loop output remains unchanged. Meanwhile, the PWM dimming control signal 14 sends the shutdown signal 22 to the main control circuit 12. The main control circuit 12 acts on the LED driver main circuit 10 and shuts it down, then the output current turns zero.

Figure 5:
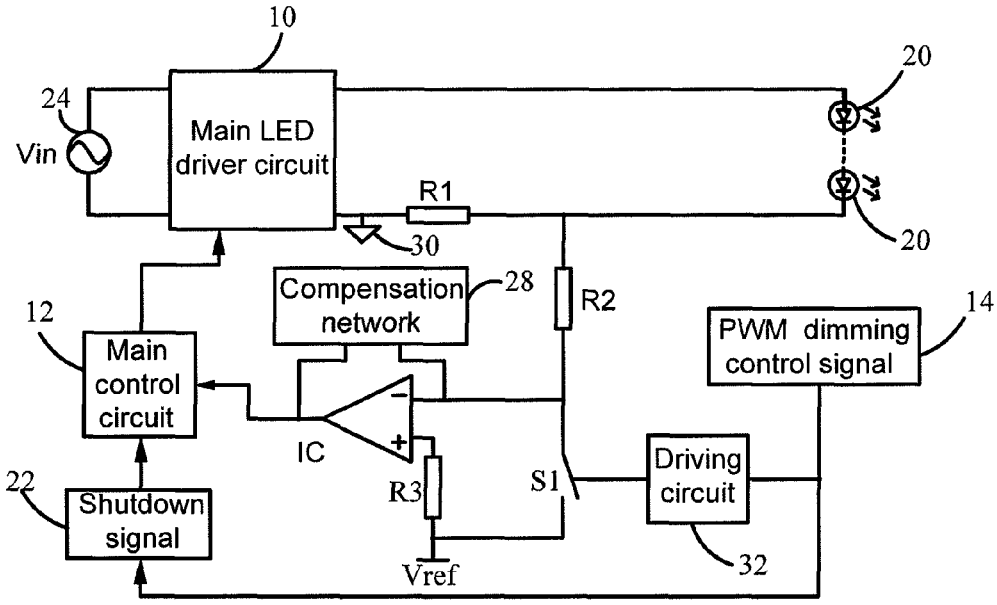
FIG. 5 is another exemplary embodiment of a circuit diagram of a PWM dimming circuit for a LED with an output of the LED driver main circuit not including an output capacitor.

FIG. 5 is another exemplary embodiment of a circuit diagram of a PWM dimming circuit for a LED with an output of the LED driver main circuit not including an output capacitor. The input of the LED driver main circuit 10 is the AC voltage Vin, and the positive output terminal connects an anode of the LED load 20, while the cathode of the LED load is connected with one end of a first resistor R1 and one end of a second resistor R2. The current loop 18 comprises an integrated operational amplifier IC, a compensation network 28, as well as the first resistor R1 and the second resistor R2. A negative input terminal of the IC connects with the other end of the second resistor R2, and then the other end of the first resistor R1 is connected to the ground 30. A positive input terminal of the IC is connected to one end of a third resistor R3, while the other end of the resistor R3 connects to the current-reference voltage Vref. The compensation network 28 is connected in parallel with the negative input terminal and the output of the integrated op-amp IC. The IC output terminal connects with the main control circuit 12. The current loop regulation circuit 16 consists of one switch S1 and its driving circuit 32. The second terminal of the switch 32 is connected to the negative input terminal of the integrated op-amp IC and the second resistor R2, while the first terminal of the switch S1 is connected to the current-reference signal Vref and the third resistor R3, and the third terminal of the switch S1 connects with its driving circuit 32 which is controlled by the PWM dimming control signal 14. The PWM dimming control signal 14 controls the shutdown signal 22, and the main control circuit 12 receives the shutdown signal and the signal of the current loop 18, then outputs the control signal to the LED driver main circuit 10.

During the 'Ton' Time, the PWM dimming control signal 14 does not output a shutdown signal 22 to the main control circuit 12. The PWM dimming control signal 14 controls the output of the switch driving circuit 32 to be low, and the switch S1 is off. The current loop 18 works in a closed-loop mode, namely that a current sampling signal is input to the negative input terminal of the integrated op-amp IC by resistor R1, then it compares with the current-reference signal Vref of the positive terminal of the integrated op-amp IC, and outputs the signal to the main control circuit 12. The main control circuit 12 acts on the LED driver main circuit 10 to set its output current as the predetermination load current. During the 'Toff' time, the PWM dimming control signal 14 controls the output of the switch driving circuit 32 to be high, and the switch S1 is on. The current sample signal of current loop 18 is forced to be equal to the current-reference signal Vref, and the current loop output remains unchanged. Meanwhile, the PWM dimming control signal 14 sends shutdown signal to the main control circuit 12. The main control circuit 12 acts on the LED driver main circuit 10 and shuts it down, then the output current turns zero.

Figure 6:
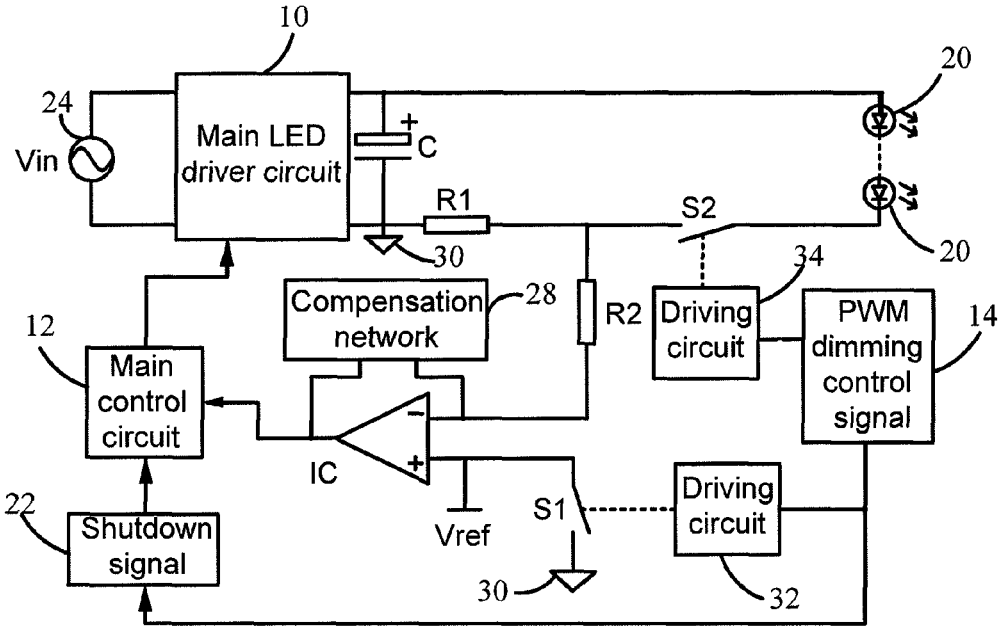
FIG. 6 is another exemplary embodiment of a circuit diagram of a PWM dimming circuit for a LED where the output of LED driver main circuit, with an output capacitor, needs to turn a main control circuit off in 'Toff' duration.

FIG. 6 is another exemplary embodiment of a circuit diagram of a PWM dimming circuit for a LED where the output of LED driver main circuit, with an output capacitor, needs to turn a main control circuit off in 'Toff' duration. The input of LED driver main circuit 10 is the AC voltage Vin, and the output is in parallel with the capacitor C. The positive output terminal of LED driver main circuit connects with the anode of the LED load, while the cathode of LED load is connected with the second terminal of an output control switch S2, and the third terminal of it connects with a second driving circuit 34 which is controlled by the PWM dimming control signal 14. The first terminal of the switch S2 connects with one end of resistor R1 and one end of resistor R2. The current loop 18 is composed of an integrated operational amplifier IC, an compensation network 28, as well as resistor R1 and resistor R2. The negative input terminal of the IC connects with the other end of resistor R2, and the other end of resistor R1 is connected to ground 30. The positive input terminal of the IC is connected to the current-reference voltage Vref. The compensation network 28 is in parallel with the negative input terminal and the output of the integrated op-amp IC. The IC output connects with the main control circuit 12. The current loop regulation circuit 16 consists of the switch S1 and its driving circuit 32. The second terminal of switch S1 is connected to the positive input terminal of the integrated op-amp IC and the current-reference signal Vref, while the first terminal of it is connected to ground 30 and the third terminal of it connects with its driving circuit 32 which is controlled by the PWM dimming control signal 14. The PWM dimming control signal 14 controls the shutdown signal 22, while the main control circuit 12 receives the shutdown signal 22 and the current loop regulation, then outputs the control signal to the LED driver main circuit 10.

During the 'Ton' Time, the PWM dimming control signal 14 controls the output of the second driving circuit 34 to be high, and the output control switch S2 is on. The PWM dimming control signal 14 controls the output of the output switch S2 driving circuit 34 to be low, and the output control switch S2 is off. The current loop regulation circuit 16 does not work (no change on the original working state of the current loop). The current sampling signal compares with the current-reference signal Vref inside of the current loop 18 and then outputs the signal to the main control circuit 12 to set its output current as the predetermination load current. During the 'Toff' time, the PWM dimming control signal 14 controls the output of the switch S1 driving circuit 32 to be high, and the switch S1 is on. The current sample signal of the current loop 18 and the current-reference signal are zero, and the current loop output remains unchanged. The current loop 18 outputs the signal to the main control circuit 12. The PWM dimming control signal 14 controls the output control switch S2 to be off and the LED load current turns zero. Meanwhile, the PWM dimming control signal 14 sends the shutdown signal 22 to the main control circuit 12 and shuts the LED driver main circuit 10 down, and the output current turns zero.

Figure 7:
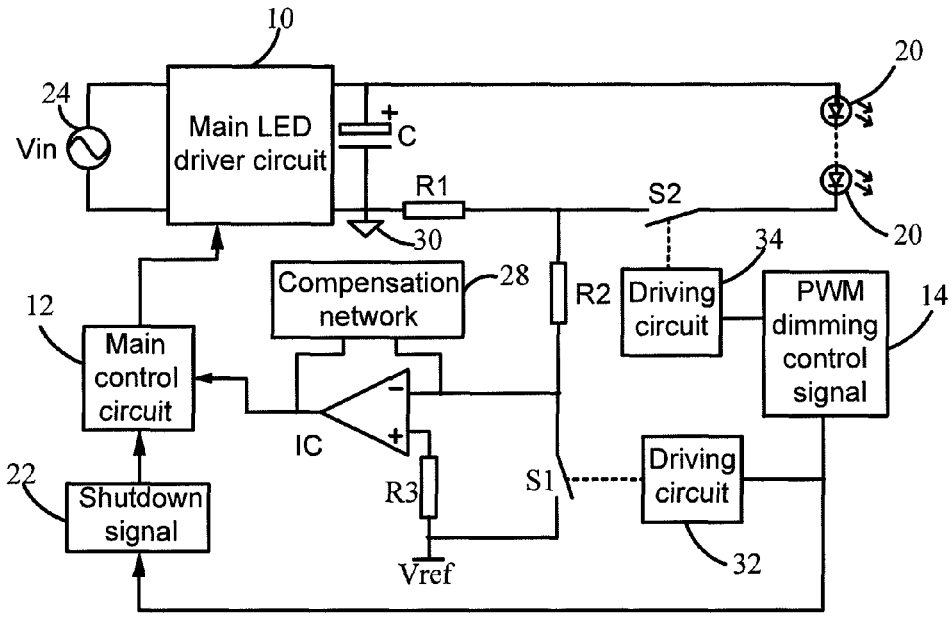
FIG. 7 is another exemplary embodiment of a circuit diagram of a PWM dimming circuit for a LED where the output of LED driver main circuit, with an output capacitor, needs to turn a main control circuit off in 'Toff' duration.

FIG. 7 is another exemplary embodiment of a circuit diagram of a PWM dimming circuit for a LED where the output of LED driver main circuit, with an output capacitor, needs to turn a main control circuit off in 'Toff' duration. The input of LED driver main circuit 10 is the AC voltage Vin, and the output is in parallel with the capacitor C. The positive output terminal of the LED driver main circuit 10 connects with the anode of the LED load 20, while the cathode of the LED load 20 is connected with the second terminal of the output control switch S2, and the third terminal of it connects with the driving circuit 34 which is controlled by the PWM dimming control signal 14. The first terminal of the output control switch S2 connects with one end of resistor R1 and one end of resistor R2. The current loop 18 is comprised of an integrated operational amplifier IC, compensation network 28, as well as resistor R1 and resistor R2. The negative input terminal of the IC connects with the other end of resistor R2, and the other end of resistor R1 is connected to the ground 30. The positive input terminal of the IC is connected to one end of resistor R3, and the other end of resistor R3 connects with the current-reference voltage Vref. The compensation network 28 is in parallel with the negative input terminal and the output of the integrated op-amp IC. The IC output connects with the main control circuit 12. The current loop regulation circuit 16 consists of the switch S1 and its driving circuit 32. The second terminal of switch S1 is connected to the negative input terminal of the integrated op-amp IC. Furthermore, the first terminal of switch S1 is connected to the current-reference signal Vref and resistor R3. The third terminal of switch S1 is connected to its driving circuit 32 which is controlled by the PWM dimming control signal 14. The PWM dimming control signal 14 controls the shutdown signal 22, while the main control circuit 12 receives the shutdown signal 22 and the current loop regulation signal, then outputs a control signal to the LED driver main circuit 10.

During the 'Ton' Time, the PWM dimming control signal 14 controls the output of the switch S1 driving circuit 32 to be high, and the switch S1 is on. The PWM dimming control signal 14 controls the output of the switch S1 driving circuit 32 to be low, and the switch S1 is off. The current loop regulation circuit 16 does not work (no change on the original working state of the current loop). The current sampling signal compares with the current-reference signal Vref inside of the current loop 18 and then outputs the signal to the main control circuit 12 to set its output current as the predetermination load current. During the 'Toff' time, the PWM dimming control signal 14 controls the output of the switch S1 driving circuit 32 to be high, and the switch S1 is on. The current sample signal of the current loop 18 equals to the current-reference signal and the current loop 18 output remains unchanged. The current loop outputs the signal to the main control circuit 12. The PWM dimming control signal 14 controls the switch S2 to be off and the LED load current turns zero. Meanwhile, the PWM dimming control signal 14 sends the shutdown signal 22 to the main control circuit 12 and shuts the LED driver main circuit 10 down, and the output current turns zero.

Figure 8:
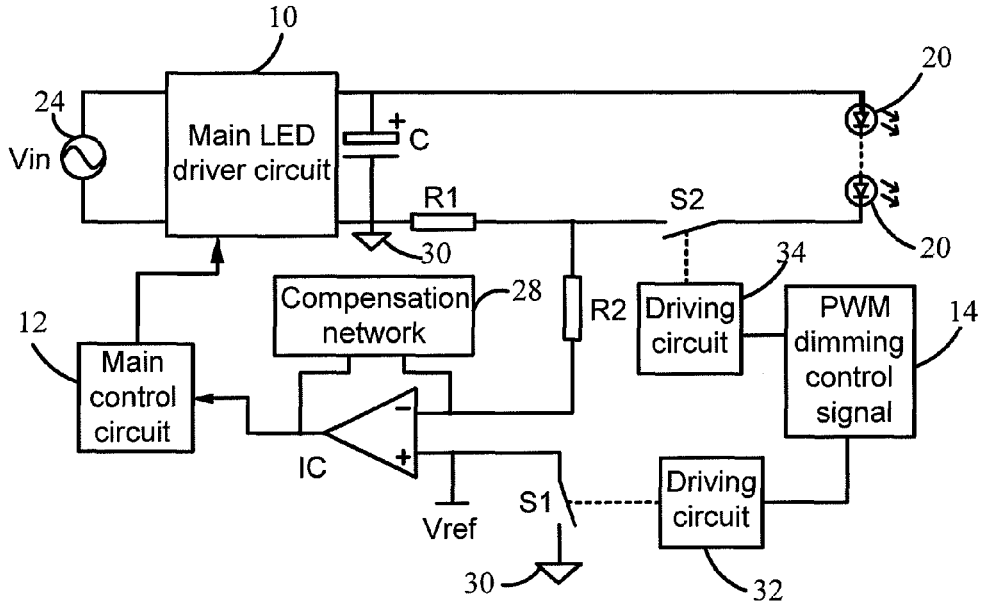
FIG. 8 is an exemplary embodiment of a circuit diagram of a PWM dimming circuit for a LED where the output of LED driver main circuit, with the output capacitor, but does not need to turn the main control circuit off in 'Toff' duration.

FIG. 8 is an exemplary embodiment of a circuit diagram of a PWM dimming circuit for a LED where the output of LED driver main circuit, with the output capacitor, but does not need to turn the main control circuit off in 'Toff' duration. The input of the LED driver main circuit 10 is the AC voltage Vin, and the output is in parallel with the capacitor C. The positive output terminal of the LED driver main circuit 10 is connected to the anode of the LED load 20, while the cathode of the LED load 20 is connected with the second terminal of the output control switch S2, and the third terminal of it connects with its driving circuit 34 which is controlled by the PWM dimming control signal 14. The first terminal of the switch S2 connects with one end of resistor R1 and one end of resistor R2. The current loop 18 comprises an integrated operational amplifier IC, a compensation network 28, as well as resistor R1 and resistor R2. The negative input terminal of the IC connects with the other end of resistor R2, and the other end of resistor R1 is connected to ground 30. The positive input terminal of the IC is connected to the current-reference voltage Vref. The compensation network is in parallel with the negative input terminal and output of the integrated op-amp IC. The IC output connects with the main control circuit 12. The current loop regulation circuit 16 comprises the switch S1 and its driving circuit 32. The second terminal of switch S1 is connected to the positive input terminal of the integrated op-amp IC and the current-reference signal Vref. The first terminal of switch S1 is connected to ground 30. The third terminal of switch S1 is connected to its driving circuit 32 which is controlled by the PWM dimming control signal 14. The main control circuit 12 receives the current loop regulation, then outputs control signal to the LED driver main circuit.

During the 'Ton' Time, the PWM dimming control signal controls the output of the switch S2 driving circuit 34 to be high, and the switch S2 is on. The PWM dimming control signal 14 controls the output of the switch S1 driving circuit to be low, and the switch S1 is off. The current loop regulation circuit 16 does not work (no change on the original working state of the current loop). The current sampling signal compares with the current-reference signal Vref inside of the current loop and then outputs the signal to the main control circuit 12 to set its output current as the predetermination load current. During the 'Toff time', the PWM dimming control signal 14 controls the output of the switch S1 driving circuit 32 to be high, and the switch S1 is on. The current sample signal of the current loop 18 and the current-reference signal turn zero, and the current loop output remains unchanged. The current loop outputs signal to the main control circuit 12. The PWM dimming control signal controls the switch S2 to be off and the LED load current turns zero.

Figure 9:
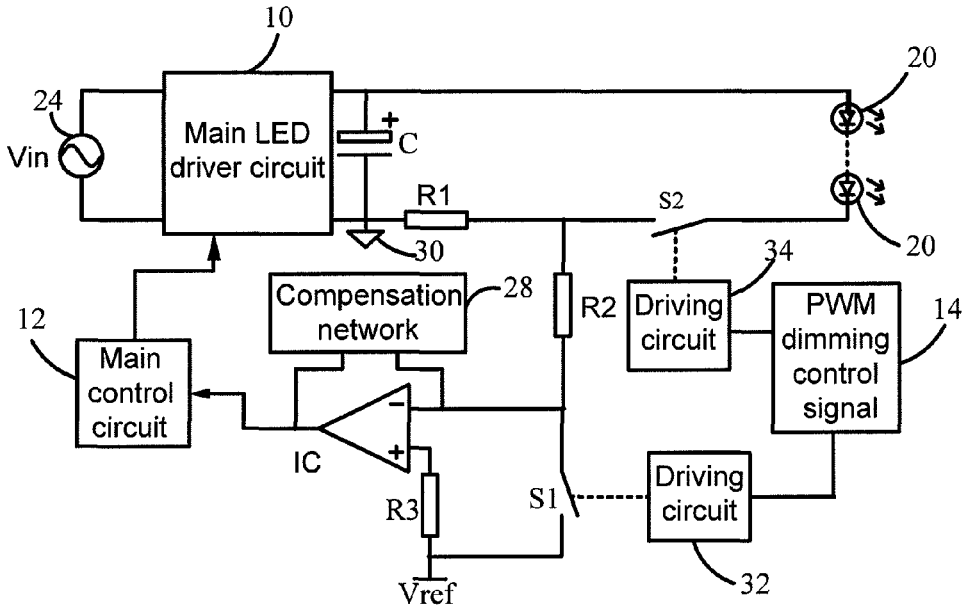
FIG. 9 is an exemplary embodiment of a circuit diagram of a PWM dimming circuit for a LED where the output of LED driver main circuit, with the output capacitor, but does not need to turn the main control circuit off in 'Toff' duration.

FIG. 9 is an exemplary embodiment of a circuit diagram of a PWM dimming circuit for a LED where the output of LED driver main circuit, with the output capacitor, but does not need to turn the main control circuit off in 'Toff' duration. The LED driver output includes an output capacitor C and the main circuit is required to be shutdown during the 'Toff' time. The input of the LED driver main circuit is the AC voltage Vin, and the output is in parallel with the capacitor C. The positive output terminal of the LED driver main circuit 10 connects with the anode of LED light load, while the cathode of the LED light load is connected with the second terminal of the output control switch S2, and the third terminal of it connects with its driving circuit 34 which is controlled by the PWM dimming control signal 14. The first terminal of the switch S2 connects with one end of resistor R1 and one end of resistor R2. The current loop 18 comprises an integrated operational amplifier IC, a compensation network 28, as well as resistor R1 and resistor R2. The negative input terminal of the IC is connected to the other end of resistor R2, and the other end of resistor R1 is connected to ground 30. The positive input terminal of the IC is connected to one end of a resistor R3, and the other end connects with the current-reference voltage Vref. The compensation network 28 is in parallel with the negative input terminal and output of the integrated op-amp IC. The IC output connects with the main control circuit 12. The current loop regulation circuit 16 comprises the switch S1 and its driving circuit 32. The second terminal of switch 51 is connected with the negative input terminal of the integrated op-amp IC. And the first terminal of switch S1 connects with the current-reference signal Vref and resistor R3. The third terminal of switch S1 connects with its driving circuit 32 which is controlled by the PWM dimming control signal 14. The main control circuit 12 receives the current loop regulation, then outputs a control signal to the LED driver main circuit 10.

During the 'Ton' Time, the PWM dimming control signal 14 controls the output of the switch S2 driving circuit 34 to be high, and the switch S2 is on. The PWM dimming control signal 14 controls the output of the switch S1 driving circuit to be low, and the switch S1 is off. The current loop regulation circuit 16 does not work (no change on the original working state of the current loop). The current sampling signal compares with the current-reference signal Vref inside of the current loop 18 and then outputs signal to the main control circuit to set its output current as the predetermination load current. During the 'Toff' time, the PWM dimming control signal 14 controls the output of the switch S1 driving circuit 32 to be high, and the switch S1 is on. The current sample signal of the current loop 18 is equal to the current-reference signal, and the current loop output remains unchanged. The current loop 18 outputs the signal to the main control circuit 12. The PWM dimming control signal 14 controls the switch S2 to be off and the LED load current turns zero.

Figure 10:
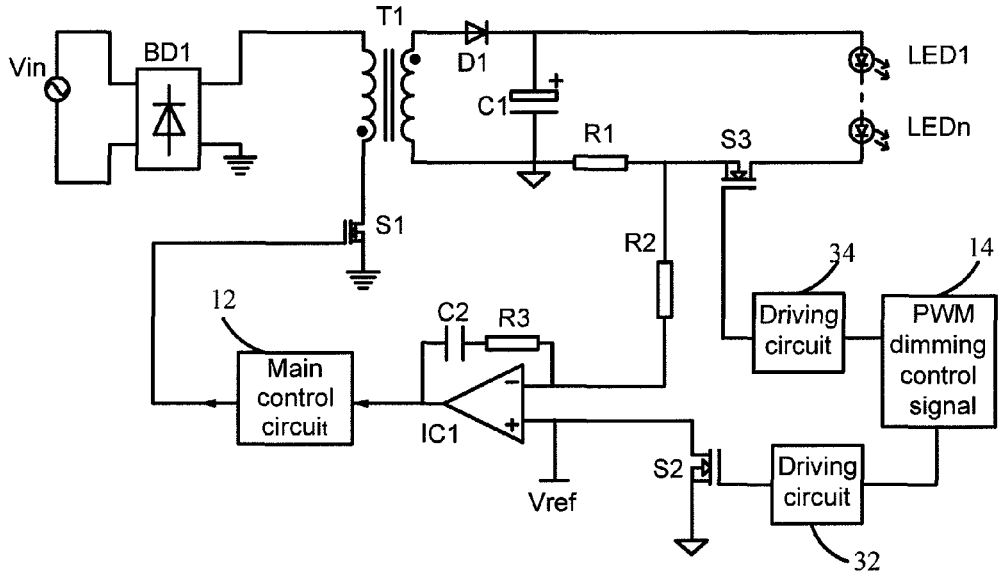
FIG. 10 is another exemplary embodiment of a circuit diagram of a PWM dimming circuit for a LED further illustrating an exemplary LED driver main circuit.

FIG. 10 is another exemplary embodiment of a circuit diagram of a PWM dimming circuit for a LED as disclosed in FIG. 8, further illustrating an exemplary LED driver main circuit and an exemplary compensation network. As illustrated, the LED driver main circuit 10 comprises a transformer T1, such as but not limited to a dual pole transformer, a diode D1, a bridge rectifier BD1, and a switch S1. The switch S1 may be a solid state switch. Also, as illustrated, the other switches S2, S3 may also be solid state switches. As illustrated the third solid state switch S2 has a first lead connected to the a second driving circuit, a second lead connected to the integrated op-amp IC, and a third lead connected to ground. The compensation network 28 comprises a second capacitor C2 in series with a third resistor R3.

Thus, in an exemplary embodiment, the present invention provides for a PWM dimming circuit for LED lighting applications. The circuit includes a main LED drive circuit, a main control circuit, a PWM dimming control signal, a current loop regulating circuit, a current loop, and an LED load. The output current waveform of the LED drive circuit is chop square wave, the frequency and duty cycle of which are the same as that of the PWM dimming control signal, and its amplitude remains constant. The average output current equals a product of the output current amplitude and the duty cycle. The output current's duty cycle varies with the duty cycle of the PWM dimming control signal, and they always keep line with each other. In this way, the average output current varies with the duty cycle of the PWM dimming control signal. As a result, when the PWM dimming control signal's duty cycle increases, the duty cycle of the output current and the average output current increase, so the LED lamp gets brighter, and the vice versa. Furthermore, LED lamp current can change quickly with the PWM signal duty cycle to get a good dimming result.

It will be understood that examples are just the illumination of the present invention, but not limited to the invention. All extended solution or substitution based on the principle and content of this invention should be regarded as the inventors' claims to be protected. Furthermore, while the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated, any use of the terms first, second, etc., do not denote any order or importance, but rather the terms first, second, etc., are used to distinguish one element from another.

What is claimed is:

1. A PWM dimming circuit for a LED lighting application, the circuit comprising:

a main LED drive circuit;

a LED load connected to the main LED drive circuit;

a current loop configured to measure output current from the LED load;

a current loop regulation circuit connected to the current loop;

a main control circuit configured to receive a signal from the current loop;

a PWM dimming controller configured to provide a signal to control the current loop regulation circuit and to make the current loop operate in a closed-loop mode during a period that the LED load has an output current, and to provide a shutdown signal to the main control circuit during a period that the LED load has no output current;

wherein during the period that the LED load has the output current, the main control circuit controls the main LED drive circuit to set its output current at a predetermined load current;

wherein during the period that the LED load has no output current, the main control circuit controls the main LED driver circuit to shut down; and wherein during the period that the LED load has no output current, the PWM dimming controller controls the current loop regulation circuit so that a current sampling signal of the current loop is forced to be equal to a current reference signal from an output of the current loop regulation circuit, so that the output of the current loop remains unchanged.

2. The circuit according to claim 1, wherein when the PWM dimming controller controls the current loop regulation circuit to work in the closed-loop mode, a current sampling signal compares with an internal current reference signal of the current loop, and the output signal of the current loop is adjusted through the closed-loop.

3. The circuit according to claim 1, further comprising:

an AC voltage provider as an input to the main LED drive circuit;

a first resistor connected at a first end to a cathode of the LED load and at a second end to ground;

a second resistor connected at a first end to the cathode of the LED load;

an integrated operational amplifier component having an output terminal, a positive input terminal and a negative input terminal, the positive input terminal is connected to a current-reference voltage, the negative input terminal is connected to a second end of the second resistor, and the output terminal of the integrated operational amplifier component is connected to the main control circuit;

a compensation network connected in parallel with the integrated operational amplifier component at the negative input terminal and output terminal of the integrated operational amplifier component;

wherein a positive output terminal of the main LED drive circuit is connected to an anode of the LED load; and wherein the current loop comprises the integrated operational amplifier component, the compensation network, the first resistor, and the second resistor.

4. The circuit according to claim 3, further comprising the current loop regulation circuit comprises a first switch and a driving circuit, wherein a second terminal of the first switch is connected to the positive input terminal of the integrated operational amplifier component and the current-reference voltage, a first terminal of the first switch is connected to ground, and a third terminal of the first switch is connected to the driving circuit which is controlled by the PWM dimming controller.

5. The circuit according to claim 1, further comprising:

an AC voltage provider as an input to the main LED drive circuit;

a first resistor connected at a first end to a cathode of the LED load and at a second end to ground;

a second resistor connected at a first end to the cathode of the LED load;

a third resistor connected at a first end to a current-reference voltage;

an integrated operational amplifier component having an output terminal, a positive input terminal and a negative input terminal, the positive input terminal is connected to a second end of the third resistor, the negative input terminal is connected to a second end of the second resistor, and the output terminal of the integrated operational amplifier component is connected to the main control circuit;

a compensation network connected in parallel with the integrated operational amplifier component at the negative input terminal and output terminal of the integrated operational amplifier component;

wherein a positive output terminal of the main LED drive circuit is connected to an anode of the LED load; and wherein the current loop comprises the integrated operational amplifier component, the compensation network, the first resistor, and the second resistor.

6. The circuit according to claim 5, further comprising the current loop regulation circuit comprises a first switch and a driving circuit, wherein a second terminal of the switch is connected to the negative input terminal of the integrated operational amplifier component and the second resistor, a first terminal of the switch is connected to the current-reference signal and the third resistor, and a third terminal of the switch is connected to the driving circuit which is controlled by the PWM dimming control signal.

7. A PWM dimming circuit for a LED lighting application, the circuit comprising:

a main LED drive circuit;

a LED load connected to the main LED drive circuit;

an output capacitor C connected in parallel to the main LED drive circuit and the LED load;

a current loop configured to measure output current from the LED load;

a current loop regulation circuit connected to the current loop;

a main control circuit configured to receive a signal from the current loop;

an output control switch connected between the LED load and the main LED driver circuit;

a PWM dimming controller configured to controls the output control switch to let in a conduction state and to provide a signal to control the current loop regulation circuit and makes the current loop work in a closed-loop mode during a period that the LED load has an output current, and to provide a shutdown signal to the main control circuit and the output control switch during a period that the LED load has no output current;

wherein during the period that the LED load has the output current, the main control circuit controls the main LED drive circuit to set its output current at a predetermined load current; and wherein during the period that the LED load has no output current, the main control circuit controls the main LED driver circuit and the output control switch to shut down.

8. The circuit according to claim 7, wherein when the PWM dimming controller controls the current loop regulation circuit to work in the closed-loop mode, a current sampling signal compares with an internal current reference signal of the current loop, and the output signal of the current loop is adjusted through the closed-loop.

9. The circuit according to claim 7, wherein during the period that the LED load has no output current, the PWM dimming controller controls the current loop regulation circuit so that a current sampling signal of the current loop is forced to be equal to a current reference signal from an output of the current loop regulation circuit, so that the output signal of the current loop remains unchanged.

10. The circuit according to claim 7, further comprising:

an AC voltage provider as an input to the main LED drive circuit with its outputs connected in parallel with the capacitor;

a first resistor with a first end connected to a first terminal of the output control switch and a second end connected to ground;

a second resistor connected to a first terminal of the output control switch;

a first driving circuit connected to a third terminal of the output control switch and which is controlled by the PWM dimming controller;

an integrated operational amplifier component having an output terminal, a positive input terminal and a negative input terminal, the positive input terminal is connected to a current-reference voltage, the negative input terminal is connected to a second end of the second resistor, and the output terminal of the integrated operational amplifier component is connected to the main control circuit;

a compensation network connected in parallel with the integrated operational amplifier component at the negative input terminal and output terminal of the integrated operational amplifier component;

wherein a positive output terminal of the main LED drive circuit is connected to an anode of the LED load and a cathode of the LED load is connected to a second terminal of the output control switch;

wherein the current loop comprises the integrated operational amplifier component, the compensation network, as well as the first resistor and the second resistor.

11. The circuit according to claim 10, further comprising the current loop regulation circuit comprises a first switch and a second driving circuit, wherein a second terminal of the first switch is connected to the positive input terminal of the integrated operational amplifier component and the current-reference voltage, a first terminal of the first switch is connected to ground, and a third terminal of the first switch is connected to the second driving circuit which is controlled by the PWM dimming controller.

12. The circuit according to claim 7, further comprising:

an AC voltage provider as an input to the main LED drive circuit with its outputs connected in parallel with the capacitor;

a first resistor with a first end connected to a first terminal of the output control switch and a second end connected to ground;

a second resistor connected to a first terminal of the output control switch;

a third resistor connected at a first end to a current-reference voltage;

a first driving circuit connected to a third terminal of the output control switch and which is controlled by the PWM dimming controller;

an integrated operational amplifier component having an output terminal, a positive input terminal and a negative input terminal, the positive input terminal is connected to a second end of the third resistor, the negative input terminal is connected to a second end of the second resistor, and the output terminal of the integrated operational amplifier component is connected to the main control circuit; and a compensation network connected in parallel with the integrated operational amplifier component at the negative input terminal and output terminal of the integrated operational amplifier component;

wherein a positive output terminal of the main LED drive circuit is connected to an anode of the LED load and a cathode of the LED load is connected to a second terminal of the output control switch;

wherein the current loop comprises the integrated operational amplifier component, the compensation network, as well as the first resistor and the second resistor.

13. The circuit according to claim 12, further comprising the current loop regulation circuit comprises a first switch and a driving circuit, wherein a second terminal of the switch is connected to the negative input terminal of the integrated operational amplifier component and the second resistor, a first terminal of the switch is connected to the current- reference signal and the third resistor, and a third terminal of the switch is connected to the driving circuit which is controlled by the PWM dimming control signal.

14. A PWM dimming circuit for a LED lighting application, the circuit comprising:

a main LED drive circuit;

a LED load connected to the main LED drive circuit;

an output capacitor connected in parallel to the main LED drive circuit and the LED load;

a current loop configured to measure output current from the LED load;

a current loop regulation circuit connected to the current loop;

a main control circuit configured to receive a signal from the current loop;

an output control switch connected between the LED load and the main LED driver circuit;

a PWM dimming controller configured to control the output control switch to let in a conduction state and to provide a signal to control the current loop regulation circuit and make the current loop work in a closed-loop mode during a period that the LED load has an output current and to provide a shutdown signal to the output control switch during a period that the LED load has no output current; and wherein during the period that the LED load has the output current, the main control circuit controls the main LED drive circuit to set its output current at a predetermined load current.

15. The circuit according to claim 14, wherein when the PWM dimming controller controls the current loop regulation circuit to work in the closed-loop mode, a current sampling signal compares with an internal current reference signal of the current loop, and the output signal is adjusted through the closed-loop.

16. The circuit according to claim 14, wherein during the period that the LED load has no output current, the PWM dimming controller controls the current loop regulation circuit so that a current sampling signal of the current loop is forced to be equal to a current reference signal from an output of the current loop regulation circuit, so that the output of the current loop remains unchanged.

17. The circuit according to claim 14, further comprising:

an AC voltage provider as an input to the main LED drive circuit with its outputs connected in parallel with the capacitor;

a first resistor with a first end connected to a first terminal of the output control switch and a second end connected to ground;

a second resistor connected to a first terminal of the output control switch;

a driving circuit connected to a third terminal of the output control switch and which is controlled by a signal from the PWM dimming controller;

an integrated operational amplifier component having an output terminal, a positive input terminal and a negative input terminal, the positive input terminal is connected to a current-reference voltage, the negative input terminal is connected to a second end of the second resistor, and the output terminal of the integrated operational amplifier component is connected to the main control circuit;

a compensation network connected in parallel with the integrated operational amplifier component at the negative input terminal and output terminal of the integrated operational amplifier component;

wherein a positive output terminal of the main LED drive circuit is connected to an anode of the LED load and a cathode of the LED load is connected to a second terminal of the output control switch;

wherein the current loop comprises the integrated operational amplifier component, the compensation network, as well as the first resistor and the second resistor.

18. The circuit according to claim 17, further comprising the current loop regulation circuit comprises a first switch and a second driving circuit, wherein a second terminal of the first switch is connected to the positive input terminal of the integrated operational amplifier component and the current-reference voltage, a first terminal of the first switch is connected to ground, and a third terminal of the first switch is connected to the second driving circuit which is controlled by the PWM dimming controller.

19. The circuit according to claim 14, further comprising:

an AC voltage provider as an input to the main LED drive circuit with its outputs connected in parallel with the capacitor;

a first resistor with a first end connected to a first terminal of the output control switch and a second end connected to ground;

a second resistor connected to a first terminal of the output control switch;

a third resistor connected at a first end to a current-reference voltage;

a driving circuit connected to a third terminal of the output control switch and which is controlled by a signal from the PWM dimming controller;

an integrated operational amplifier component having an output terminal, a positive input terminal and a negative input terminal, the positive input terminal is connected to a second end of the third resistor, the negative input terminal is connected to a second end of the second resistor, and the output terminal of the integrated operational amplifier component is connected to the main control circuit;

a compensation network connected in parallel with the integrated operational amplifier component at the negative input terminal and output terminal of the integrated operational amplifier component;

wherein a positive output terminal of the main LED drive circuit is connected to an anode of the LED load and a cathode of the LED load is connected to a second terminal of the output control switch;

wherein the current loop comprises the integrated operational amplifier component, the compensation network, as well as the first resistor and the second resistor; and wherein the current loop regulation circuit further comprises a first switch and a second driving circuit, wherein a second terminal of the first switch is connected to the positive input terminal of the integrated operational amplifier component and the current-reference voltage, a first terminal of the first switch is connected to ground, and a third terminal of the first switch is connected to the second driving circuit which is controlled by the PWM dimming controller.

* * * * *